United States Patent [19]

Sawyer

[11] 4,042,095

[45] Aug. 16, 1977

[54] HIGH DENSITY MERCHANDISE DISPLAY AND RACK

[76] Inventor: George M. Sawyer, 8801 Calico Ave., Garden Grove, Calif. 92641

[21] Appl. No.: 633,863

[22] Filed: Nov. 20, 1975

[51] Int. Cl.[2] ..... A47F 7/00

[52] U.S. Cl. ..... 211/49 D; 40/10 R; 47/56; 206/488; 402/70

[58] Field of Search ..... 47/56; 248/44, 75, 80, 248/153, 89, 97, 158, 176, 73, 175; 211/1, 22, 44, 45, 49 R, 49 D, 50, 54, 57, 59, 60 R, 60 A, 61, 181, 59.1; 40/11, 124, 124.1, 10 R; D8/233-243; D96/12 J; D6/180; 402/71-73, 70; 206/486, 491, 588, 806, 493

[56] References Cited

U.S. PATENT DOCUMENTS

| | | | |
|---|---|---|---|
| 341,482 | 5/1886 | Husted | 40/10 X |
| 657,317 | 9/1900 | Lancaster | 402/71 |
| 1,033,583 | 7/1912 | Hart | 248/153 |
| 1,620,148 | 3/1927 | Williams | 211/59 |
| 1,695,935 | 12/1928 | Vesley | 211/59.1 |
| 2,626,061 | 1/1953 | Girouard | 211/59 |
| 3,307,693 | 3/1967 | Bittner | 206/461 |
| 3,754,643 | 8/1973 | Foster | 47/56 |
| D32,692 | 5/1900 | Muth | D8/245 |

*Primary Examiner*—Edgar S. Burr
*Assistant Examiner*—James R. Feyrer
*Attorney, Agent, or Firm*—William W. Haefliger

[57] ABSTRACT

A high density merchandise display comprises a. a base and a support rod extending upwardly from the base, and b. multiple display units for said merchandise fanning outwardly from and spaced circularly about the rod, the units having stacked relation.

The units may include cards with items of merchandise thereon located near the periphery of the display, to be seen, and the cards may have overlap limited by containers for the merchandise on the cards. Also, a simple rack design is provided for the display.

1 Claim, 3 Drawing Figures

HIGH DENSITY MERCHANDISE DISPLAY AND RACK

BACKGROUND OF THE INVENTION

This invention relates generally to merchandise displays. More particularly, it concerns a highly compact display wherein a large number of card supported items are arrayed to present all the items for viewing.

In recent years, cards or sheets have been utilized to support small items of merchandise, the cards containing openings to receive rack wires for hanging the cards in rows. One disadvantage is found in the waste of display space in that the cards and supported items are not sufficiently condensed or compacted. This difficulty arises from the fact that the items normally project outwardly from the cards, so that extreme condensation of the display has not been possible. Another disadvantage lies in the lack of visibility of the items of merchandise on cards concealed behind the first card in the row, on existing racks.

SUMMARY OF THE INVENTION

It is a major object of the invention to provide a highly compact display obviating the above disadvantages, the items of merchandise being displayed in highly visible manner.

Basically, the display includes:

a. a base and a support rod extending upwardly from the base, and b. multiple display units for said merchandise fanning outwardly from and spaced circularly about the rod, the units having stacked relation.

As will appear, each unit typically includes a sheet or card and an item of merchandise supported in a container on the card; circularly adjacent units have substantial sheet overlap; and the merchandise containers are located near the periphery of the generally circular display and stand outwardly and vertically from the sheets. Further, the rack preferably includes a second rod connected with the base and standing upwardly near the periphery of the display to support advertising; and the base and rods have very simple and effective construction.

These and other objects and advantages of the invention, as well as the details of an illustrative embodiment, will be more fully understood from the following description and drawings, in which:

DRAWING DESCRIPTION

DETAILED DESCRIPTION

Figure 1:
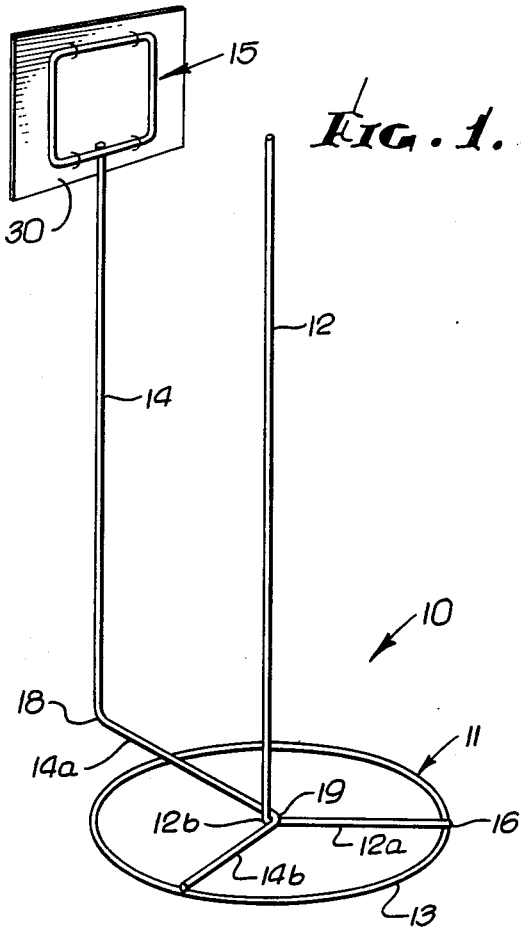
FIG. 1 is a perspective view of a display rack for the high density display.

Referring first to FIG. 1, the rack 10 includes a base 11 and a first support rod 12 extending upwardly from the base. As shown, the base may be defined by a wire or rod 13 spaced outwardly of the axis of rod 12, as in a loop or ring, and the rod may have a lower extent **12*a* extending radially from a central bend 12*b* to join the wire ring 13 at 16. A second rod 14 is also connected with the base, and extends upwardly to support an advertising loop 15 at about the height of the upper end of rod 12. Rod 14 has lower extents 14*a* and 14*b*, the former extending radially inwardly from a first bend 18 to a second bend 19, where it joins extent 14*b*. Bend 18 is spaced outwardly of ring 13, whereas bend 19 is adjacent bend 12*b* at the center of the ring. A sheet of advertising may be attached in any convenient manner to loop 15, as seen at 30**.

Multiple display units 20 for merchandise are loosely retained on and by the rod to fan outwardly therefrom, the units 20 spaced circularly about the rod and having stacked relationship. Each unit 20 typically includes a sheet, such as a card 21, and one or more items of merchandise carried on the sheet. That item may be enclosed within a typically transparent (as for example plastic) container as at 22 mounted on the card, the container and enclosed merchandise standing out vertically from the plane of the card. Further, the container is commonly circular and located on the card radially outwardly from an opening 23 in the card and through which the rod 12 projects. The opening 23 and the container are on a line which also bisects the card, radially.

It will be noted that a very high density relationship of display units 20 is achieved by their fan arrangement coupled with overlapping of circularly adjacent units. Such overlap is characterized in that an upper side edge 24 of each card extends adjacent a container 22 on the next card. Also, it will be noted that the units 20 are stacked on one another to form columns of containers which are circularly spaced about the rod 12, and inclined slightly from vertical.

Figure 3:
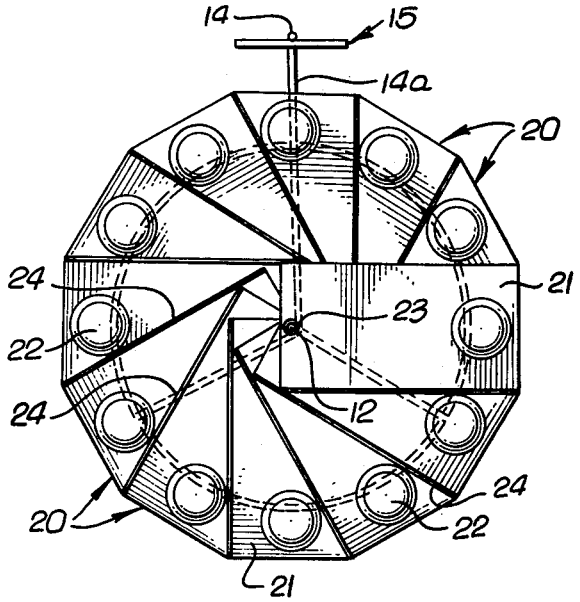
FIG. 3 is a plan view on lines 3—3 of FIG. 2.
Figure 2:
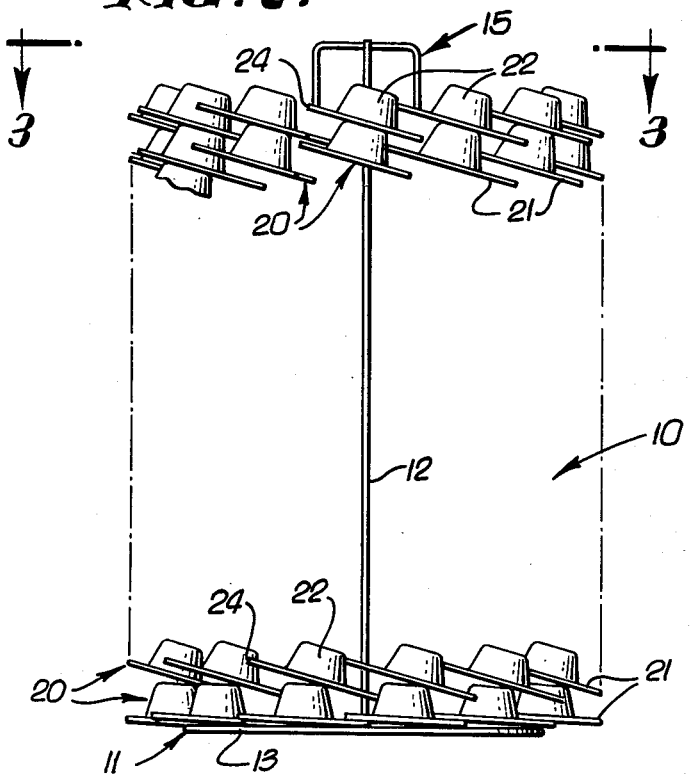
FIG. 2 is an elevational view of the merchandise display on the rack.

Rod 14 is seen in FIG. 3 to extend upright near but spaced from the display of units 20.

Accordingly, the containers for the merchandise are exhibited near the periphery of the display for maximum side and top viewing; the units may be easily removed off the rod from the top; and a very high density, highly compact display, together with advertising on rod 14, is achieved.

The merchandise in each container may, for example, consist of a seed such as a peanut, and a water permeable, flexible support (such as yarn) for the seed. Thus, each container and its contents consists of a seed sprouting kit, the associated card carrying instructions for its use.

I claim:

1. In a high density merchandise display, a. a base and a support rod extending upwardly from the base, and b. multiple display units for said merchandise fanning outwardly from and spaced circularly about the rod, the units having stacked relation, c. each unit including a sheet, and including an item of merchandise carried on the sheet, the sheet containing an opening through which the rod projects, the item of merchandise located radially outwardly of the opening, all of said items of merchandise standing generally vertically in the same direction outwardly of the sheets and forming circularly spaced columns which are inclined from vertical, the sheets being interleaved, each sheet having an edge extending adjacent the side of a container for an item of merchandise on another adjacent and interleaved sheet, said edge extending generally horizontally, circularly adjacent units having sheet overlap producing tilting of substantially all sheets from horizontal, d. each sheet comprising a card, and each item of merchandise being enclosed in one of said containers on the card, the container comprising a transparent receptacle standing outwardly from the plane of the card, the receptacles located closer to the edges of the cards remote from the support rod than to the edges closest to said rod, e. the base substantially flat and formed by means spaced outwardly from and extending about said axis, and adjacent which the lowermost cards extend substantially horizontally, f. the display formed by said units being substantially cylindrical in outline, throughout the height thereof.

* * * * *